US006290474B1

(12) United States Patent
Bavendiek et al.

(10) Patent No.: US 6,290,474 B1
(45) Date of Patent: Sep. 18, 2001

(54) MACHINE HYDRAULIC SYSTEM

(75) Inventors: Rainer Bavendiek, Wentorf; Claus-Peter Jahns, Hamburg, both of (DE)

(73) Assignee: Still, GmbH (DE)

( * ) Notice: Subject to any disclaimer, the term of this patent is extended or adjusted under 35 U.S.C. 154(b) by 0 days.

(21) Appl. No.: 09/449,304

(22) Filed: Nov. 24, 1999

(30) Foreign Application Priority Data

Nov. 25, 1998 (DE) ..... 198 54 417

(51) Int. Cl.[7] ..... F04B 17/00; F04B 35/00

(52) U.S. Cl. ..... 417/423.3; 60/475; 91/31

(58) Field of Search ..... 417/423.3, 502; 180/907; 60/475, 432, 453, 325, 477, 484; 92/144; 254/186 R, 93 R; 425/242 R; 91/31; 137/625.24, 101, 599.8, 625.23

(56) References Cited

U.S. PATENT DOCUMENTS 3,754,394 * 8/1973 Morrison ..... 60/484
3,918,683 * 11/1975 Millar ..... 254/93 R
3,988,089 * 10/1976 Hehl ..... 425/145
3,988,099 * 10/1976 Hehl ..... 425/145
4,005,636 * 2/1977 Dunn ..... 91/31
4,169,580 * 10/1979 Hatlapa et al. ..... 254/361
4,551,973 * 11/1985 Broadhead ..... 60/477
4,773,494 * 9/1988 Anderson ..... 7/180.12
4,844,197 * 7/1989 Maissa ..... 181/105
5,144,801 * 9/1992 Scanderbeg et al. ..... 60/475
5,497,621 * 3/1996 Mallett ..... 60/325

* cited by examiner

*Primary Examiner*—Teresa Walberg
*Assistant Examiner*—Leonid Fastovsky
(74) *Attorney, Agent, or Firm*—Webb Ziesenheim Logsdon Orkin & Hanson, P.C.

(57) ABSTRACT

A machine, in particular an industrial truck, is provided with a hydraulic system that has at least one reservoir (1) for hydraulic fluid and at least one hydraulic pump (5). The hydraulic pump (5) is located inside the reservoir (1). A priority valve (8*a*) is connected to the hydraulic pump (5) by a flange connection. An electric drive motor (3) of the hydraulic pump (5) can also be located inside the reservoir (1).

13 Claims, 1 Drawing Sheet

MACHINE HYDRAULIC SYSTEM

BACKGROUND OF THE INVENTION

1. Field of the Invention

This invention relates generally to a machine having a hydraulic system and, more particularly, to an industrial truck having a hydraulic system with at least one reservoir for hydraulic fluid and at least one hydraulic pump.

2. Description of the Currently Available Technology

Machines are frequently equipped with a hydraulic system, by means of which, depending on the construction of the machine, various functions of the machine are driven. On industrial trucks, for example, such functions are generally the raising and tilting of a load, the steering of the industrial truck and possibly additional loadhandling functions.

The hydraulic system generally has a reservoir from which hydraulic fluid is sucked by a pump. Installed downstream of the pump is a priority valve which can supply a hydraulic steering device with hydraulic fluid. Hydraulic fluid is also made available to additional hydraulic users by distributor valves that can be actuated as desired. Most of the users in question are hydraulic cylinders, by means of which the forces required to raise, tilt or handle a load are generated. The steering device and the other hydraulic users are also connected to the reservoir by return lines. A descent braking valve to reduce the volume of the flow of hydraulic fluid or a pilot valve to maintain a specified pressure level can be located in corresponding return lines, as necessary.

In known machines, the above mentioned hydraulic components are generally fastened separately from one another to a frame of the machine, and are connected to one another by hoses or pipelines. The known art also discloses that different hydraulic components can be combined into modules and fastened jointly to the frame of the machine. In each case, the known hydraulic systems have a series of discontinuities and connections that are sealed with seals and gaskets of various types to prevent the escape of hydraulic fluid.

Preventing the escape of hydraulic fluid from the hydraulic system is necessary to meet the requirements of occupational health and safety regulations as well as environmental protection regulations. For this purpose, complex and expensive means are employed in the manufacture of the machine to help prevent such hydraulic fluid loss. Nevertheless, during the operation of such hydraulic machines, leaks in the hydraulic system occur repeatedly. These leaks have to be detected and eliminated in the course of service and maintenance operations.

As will be appreciated by one of ordinary skill in the industrial truck art, it would be advantageous to provide a machine of the general type described above in which the danger of the escape of hydraulic fluid can be reduced or eliminated, preferably using simple means.

SUMMARY OF THE INVENTION

The invention teaches that the above object can be accomplished by locating a hydraulic pump of the hydraulic system inside the hydraulic fluid reservoir. In the event of a leak in a casing of the hydraulic pump or in its hydraulic connections, the leaking hydraulic oil flows directly into the reservoir. Consequently, it is possible to reliably eliminate contamination of the machine and/or the environment. These leaks may thus only have to be repaired in the event of major damage to the seal elements, e.g., if the leaking hydraulic fluid leads to a reduction in the performance or power of the hydraulic system. Minor leaks can be repaired during normal maintenance activities because during the normal operation of the machine they do not pose a serious risk to the safety of operators or the environment. An additional advantage of locating the pump in the reservoir is that when leaks occur in a suction area of the pump, for example on a suction tube or a filter, the entry of air into the hydraulic pump and thus damage resulting from cavitation can be prevented.

It is further advantageous if an electric motor of the hydraulic pump is located inside the reservoir. Therefore, no mechanical openings need to be made through a wall of the reservoir. The hydraulic fluid in the reservoir can be used as coolant for the electrical drive motor. The installation of the electric drive motor inside the reservoir is particularly appropriate when a maintenance-free, three-phase motor is used.

If an electric drive motor of the hydraulic pump is located outside the reservoir, a secure seal is achieved if a shaft that connects the electric drive motor with the hydraulic pump is sealed with respect to the tank by a shaft seal. This system is particularly appropriate when a direct current motor is used, which should be accessible for maintenance work that is typically performed on a regular basis.

A further improvement regarding the escape of hydraulic fluid results if a priority valve is located inside the reservoir and in flow communication with the pump. The priority valve ensures that a steering device of the machine is supplied with sufficient hydraulic fluid at all times. Leaks in the vicinity of the priority valve, for example at the hydraulic connections, do not in this arrangement result in a contamination of the environment by hydraulic fluid. Instead, the escaping hydraulic fluid is retained in the reservoir.

If the priority valve is fastened by a flange connection to the hydraulic pump, no additional hydraulic lines between these components are necessary. The hydraulic pump and priority valve can be installed in the reservoir as pre-assembled modules.

It is also advantageous if there is at least one distributing valve located inside the reservoir and in flow communication with the pump. By means of the distributing valve(s), the delivery of hydraulic fluid to various hydraulic users is controlled as a function of a signal initiated by an operator. Leaks in the distributing valve(s), which are generally proportionally controlled but which can also be realized in the form of sliding valves, are recovered in the reservoir. With sliding valves, the complex and expensive tank return, required on known devices to catch oil leaks which are unavoidable on account of the design of the system, can be eliminated. It is even possible to do without the seals that are conventionally used to prevent contamination of the sliding valves since, on account of the location of the valve(s) in the reservoir, it is not exposed to any external influences. It is also possible to do without a seal of the individual slides of the distributing valve, as a result of which the distributing valve can be manufactured more economically.

When the distributing valve(s) is located in the reservoir, it is advantageous if the distributing valve(s) is realized so that it can be actuated electrically. The distributing valve(s) can thus be located spatially independently of the corresponding control levers.

There are appropriately a plurality of distributing valves which form a distributing valve block. The distributing valve block can be installed pre-assembled into the reservoir.

It is particularly advantageous if the priority valve is a component of the distributing valve block. Therefore, no hydraulic lines that connect the priority valve with the distributing valve block are necessary.

Advantages similar to those described above are achieved if a steering valve is located inside the reservoir and in flow communication with the pump. The steering valve can also be realized in the form of a component of the distributing valve block.

Additional advantages can be achieved if there are additional hydraulic components, such as one or more pilot valves and/or a descent braking valve, located inside the reservoir. The pilot valve and the descent braking valve are typically located in the return lines from hydraulic users. The invention teaches that these components can also be located inside the reservoir.

BRIEF DESCRIPTION OF THE DRAWINGS

Additional advantages and details of the invention are explained in greater detail below with reference to the exemplary embodiment illustrated in the accompanying FIGS. 1 and 2 which schematically show a hydraulic system for an industrial truck incorporating features of the invention.

DESCRIPTION OF THE PREFERRED EMBODIMENT

Figure 1:
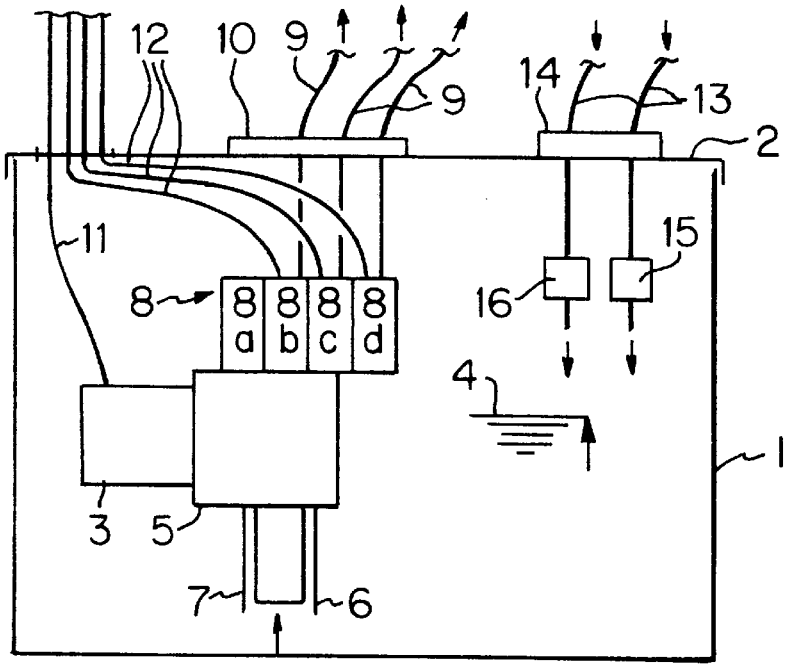
Figure 2:
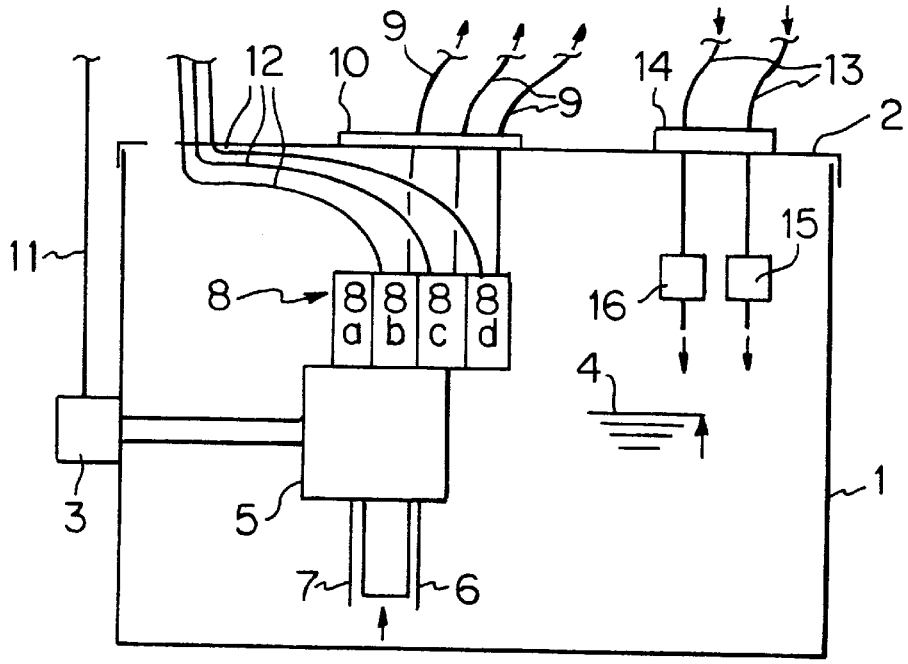

The FIGS. 1 and 2 also show a reservoir 1 of a hydraulic system of a machine, such as an industrial truck. The reservoir 1 contains hydraulic fluid and is preferably tightly closed with a reservoir cover 2. Inside the reservoir 1, the invention teaches that there are a series of components of the hydraulic system.

An electric drive motor 3, preferably a three-phase motor, is located below a fill-level line 4 of the reservoir 1, i.e., is normally immersed in hydraulic fluid, and is thus cooled by hydraulic fluid. Connected to the drive motor 3 is a hydraulic pump 5 which is driven by the drive motor 3. The hydraulic pump 5 sucks hydraulic fluid from the reservoir 1 via a suction filter 6 which is located in a suction tube 7.

In the vicinity of a discharge aperture of the hydraulic pump 5, a distributing valve block 8 is connected to, e.g., is in flow communication with, the hydraulic pump 5, preferably by a flange connection. In this exemplary embodiment, the distributing valve block 8 comprises a priority valve 8*a*, a steering valve 8*b* and two distributing valves 8*c*, 8*d*. Hydraulic pressure lines 9 lead from the steering valve 8*b* and the distributing valves 8*c*, 8*d* via a flange plate 10 to the respective hydraulic users.

Also located in the reservoir cover 2 is a lead-through for electrical lines. In this case, there is a control and supply line 11 for the electrical drive motor 3 as well as signal lines 12 to the steering valve 8*b* and the distributing valves 8*c*, 8*d*. The signal lines 12 are connected with corresponding control levers (not shown) and/or with a steering sensor (not shown), by means of which electrical control signals are generated in conventional manner.

The FIGS. 1 and 2 also show two additional return lines 13, through which hydraulic fluid flows from the various hydraulic users back into the reservoir 1. The return lines 13 are guided by means of a flange plate 14 through the reservoir cover 2 into the reservoir 1. In one return line 13, e.g., the right-most return line 13 in the drawing, which is preferably connected with a hoisting cylinder (not shown) of the machine, there is a descent braking valve 15. The descent braking valve 15 prevents an excessively rapid discharge of hydraulic fluid into the reservoir 1, and is therefore able to decelerate the descending movement of a load-holding device, for example. In the other return line 13, e.g., the left-hand return line 13 in the drawing, there is a pilot valve 16, by means of which a defined pressure in that return line can be maintained.

The invention teaches that the hydraulic pump 5, the distributing valve block 8, the descent braking valve 15 and the pilot valve 16 are preferably located inside the reservoir 1. Leaks in these hydraulic components or at their connecting points therefore do not result in contamination of the machine and/or its environment with hydraulic fluid. Instead, accidentally escaping hydraulic fluid is maintained in the reservoir 1.

It will readily be appreciated by those skilled in the art that modifications may be made to the invention without departing from the concepts disclosed in the foregoing description for example, FIG. 2 shows an embodiment with the electric drive motor 3 located outside of the reservoir 1. Such modifications are to be considered as included within the scope of the invention. Accordingly, the particular embodiments described in detail hereinabove are illustrative only and are not limiting as to the scope of the invention, which is to be given the full breadth of the appended claims and any and all equivalents thereof.

What is claimed is:

1. A machine having a hydraulic system, comprising:

at least one reservoir for hydraulic fluid;

at least one hydraulic pump, wherein the at least one hydraulic pump is located inside the reservoir; and a distributing valve block attached onto the at least one hydraulic pump, wherein the distributing valve block includes a steering valve and at least one distributing valve in flow communication with the hydraulic pump.

2. The machine as claimed in claim 1, including an electric drive motor connected to the hydraulic pump, wherein the electric drive motor is located inside the reservoir.

3. The machine as claimed in claim 1, including an electric drive motor connected to the hydraulic pump by a shaft, wherein the electric drive motor is located outside the reservoir and wherein the shaft that connects the electric drive motor with the hydraulic pump is sealed with respect to the reservoir by a shaft seal.

4. The machine as claimed in claim 1, including a priority valve located inside the reservoir and in flow communication with the pump.

5. The machine as claimed in claim 4, wherein the priority valve is connected to the hydraulic pump by a flange connection.

6. The machine as claimed in claim 1, wherein the distributing valve is electrically actuated.

7. The machine as claimed in claim 4, wherein the priority valve is a component of the distributing valve block.

8. The machine as claimed in claim 1, including additional hydraulic components located inside the reservoir.

9. The machine as claimed in claim 8, wherein the additional hydraulic components are selected from the group consisting of at least one pilot valve and at least one descent braking valve.

10. The machine as claimed in claim 2, including a priority valve located inside the reservoir and in flow communication with the pump.

11. The machine as claimed in claim 3, including a priority valve located inside the reservoir and in flow communication with the pump.

12. The machine as claimed in claim 5, wherein the priority valve is a component of the distributing valve block.

13. The machine as claimed in claim 1, wherein the distributing valve block includes a priority valve, and wherein the machine further comprises a descent braking valve located in the reservoir.

* * * * *

UNITED STATES PATENT AND TRADEMARK OFFICE

CERTIFICATE OF CORRECTION

PATENT NO. : 6,290,474 B1
DATED : September 18, 2001
INVENTOR(S) : Rainer Bavendiek et al.

It is certified that error appears in the above-identified patent and that said Letters Patent is hereby corrected as shown below:

Column 1,
Line 16, "loadhandling" should read -- load-handling --.

Column 3,
Line 29, "The FIGS. 1 and 2" should read -- FIGS. 1 and 2 --.
Line 29, "also show" should read -- show --.
Line 60, "The FIGS. 1 and 2" should read -- FIGS. 1 and 2 --.

Signed and Sealed this

Twenty-sixth Day of March, 2002

*Attest:*

*Attesting Officer*

JAMES E. ROGAN
*Director of the United States Patent and Trademark Office*